US007178769B2

(12) United States Patent
Magnusson et al.

(10) Patent No.: US 7,178,769 B2
(45) Date of Patent: Feb. 20, 2007

(54) SUSPENSION DEVICE

(75) Inventors: Reine Magnusson, Västervik (SE); Peter Nilsson, Västervik (SE)

(73) Assignee: Elfa International AB, Västervik (SE)

( * ) Notice: Subject to any disclaimer, the term of this patent is extended or adjusted under 35 U.S.C. 154(b) by 386 days.

(21) Appl. No.: 10/868,038

(22) Filed: Jun. 16, 2004

(65) Prior Publication Data

US 2005/0006541 A1 Jan. 13, 2005

Related U.S. Application Data

(60) Provisional application No. 60/482,121, filed on Jun. 25, 2003.

(30) Foreign Application Priority Data

Jun. 25, 2003 (SE) ..... 0301848

(51) Int. Cl.
*F16M 11/00* (2006.01)

(52) U.S. Cl. ..... 248/201; 248/220.21; 248/226.11; 211/119.004

(58) Field of Classification Search ..... 248/235, 248/309.1, 689, 690, 613, 612, 611, 610, 248/200.1, 205.1, 320, 207, 229.1, 227.2, 248/243, 245, 250, 283.1, 297.21, 310, 304, 248/692; 211/75, 90.01, 119.003, 117, 53, 211/207, 88.01, 90.03, 119, 187, 133.5
See application file for complete search history.

(56) References Cited

U.S. PATENT DOCUMENTS 1,156,997 A * 10/1915 Hayes ..... 403/112
1,838,244 A * 12/1931 Ahrens ..... 248/205.1
2,270,796 A * 1/1942 Hauser ..... 211/119.004
2,925,916 A * 2/1960 Pollock ..... 211/119.004
3,198,343 A * 8/1965 Pollock ..... 211/87.01
3,918,670 A * 11/1975 Doherty ..... 248/214
4,401,222 A * 8/1983 Kulikowski et al. ..... 211/94.01
4,828,120 A * 5/1989 Beil et al. ..... 211/88.01
4,846,430 A * 7/1989 Ke ..... 248/215
5,110,080 A 5/1992 Rieman
5,477,967 A * 12/1995 Voorhees et al. ..... 211/55
5,582,116 A * 12/1996 Spimpolo ..... 108/108
6,223,914 B1 * 5/2001 Snell ..... 211/119.04
D464,558 S 10/2002 Trifilio
2003/0085188 A1 * 5/2003 Klein et al. ..... 211/118

* cited by examiner

*Primary Examiner*—Carl D. Friedman
*Assistant Examiner*—Bradley Duckworth
(74) *Attorney, Agent, or Firm*—Buchanan Ingersoll & Rooney PC

(57) ABSTRACT

A device for detachable suspension of baskets, shelves, paper roll holders etc. from a door or the like, includes a carrier element with through slots or holes for holding the baskets, shelves etc., a first fastener and a second fastener, which fasteners carry the carrier element and are adapted to be fixed to the door or the like. Each of the first and second fasteners comprises an L-shaped element with a first leg, which is adapted to be engaged with one edge side of the door and its opposite edge side, respectively, and a second leg, to which the carrier element is fixed in suspension. A first hook portion is movably attached to the second leg of the first fastener, and a second hook portion is immovably attached to the second leg of the second fastener. By moving the first hook portion away from the second hook portion, the carrier element is clamped to the door.

19 Claims, 3 Drawing Sheets

SUSPENSION DEVICE

The benefit is claimed under 35 U.S.C. § 119(a)–(d) of Swedish Application No. 0301848-8, filed Jun. 25, 2003, and under 35 U.S.C. § 119(e) of U.S. Provisional Application No. 60/482,121, filed Jun. 25, 2003.

FIELD OF THE INVENTION

The present invention relates to a device for detachable suspension of baskets, shelves, paper roll holders etc. from a door or the like, comprising a carrier element with through slots or holes for holding the baskets, shelves etc., a first fastener and a second fastener, which fasteners carry the carrier element and are adapted to be fixed to the door or the like.

More specifically, the invention relates to part of a system for storing various objects suspended from a door, a separate screen wall, a display screen and the like. In cramped quarters and with restricted storage spaces, such as in cupboards, it is important to be able to provide extra storage spaces that do not interfere with the floor surface or available shelf surfaces. One way of achieving this is to mount wire baskets, shelves, suspension hooks, paper roll holders, shoe racks and the like on inner doors or the inside of cupboard doors. It is then advantageous if the baskets, shelves etc. can easily be attached to the door in an optional position or easily be replaced by another unit. Moreover it is of vital importance that the storage system can easily be mounted on and dismounted from the door, when required. It is also important for the mounting of the system not to leave any marks after being dismounted, i.e. for the appearance of the door not to be affected by the system as such.

BACKGROUND OF THE INVENTION

A system for storing various objects suspended from a door is known from U.S. Design Ser. No. 464,558. The system comprises a support rail in the form of a backbone which is intended to be screwed to a door or wall. A number of pairs of tongues project laterally from the rail, to which tongues baskets, racks, shelves etc. can be attached. The baskets etc. have a strong suspension plate which is provided with grooves and recesses and which is adapted to be pushed over the respective pairs of tongues to allow a basket to be suspended from the rail. When mounting the rail, a number of holes must be drilled in the door and screws be fastened in the door, thus leaving ugly holes in the door when the system is dismounted. Furthermore the rail is specially designed for precisely this purpose.

SUMMARY OF THE INVENTION

An object of the invention is to provide a device for detachable suspension of baskets etc., which is easy to mount on and dismount from e.g. a door.

A further object is to provide a suspension device for baskets etc. on a door or the like, which in mounting and dismounting does not damage the appearance of the door.

Yet another object of the invention is to provide a suspension device to be mounted on a door, a screen wall or the like, which is comparatively inexpensive to manufacture.

According to the invention, these objects are achieved by a suspension device as described by way of introduction, which is characterized in that each of the first and second fasteners comprises an L-shaped element with a first leg which is adapted to be engaged with one edge side of the door and the opposite edge side, respectively, and a second leg to which the carrier element is fixed in suspension, that a first hook portion is movably attached to the second leg of the one fastener, that the movable first hook portion is screwably engaged with a bolt, which is rotatably supported in a through hole in a supporting element fixedly attached to the second leg of the first fastener, essentially perpendicular to said second leg, and that the first hook portion is arranged to be inserted into the associated slot or hole in the carrier element, whereby, after positioning the fasteners and tightening the bolt, the carrier element will be suspended from the door.

Further developments of the invention are defined by the features stated in the subclaims.

DESCRIPTION OF THE DRAWINGS

Preferred embodiments of the invention will be described below by way of example and with reference to the accompanying drawings, in which.

DESCRIPTION OF THE PREFERRED EMBODIMENTS

Figure 1:
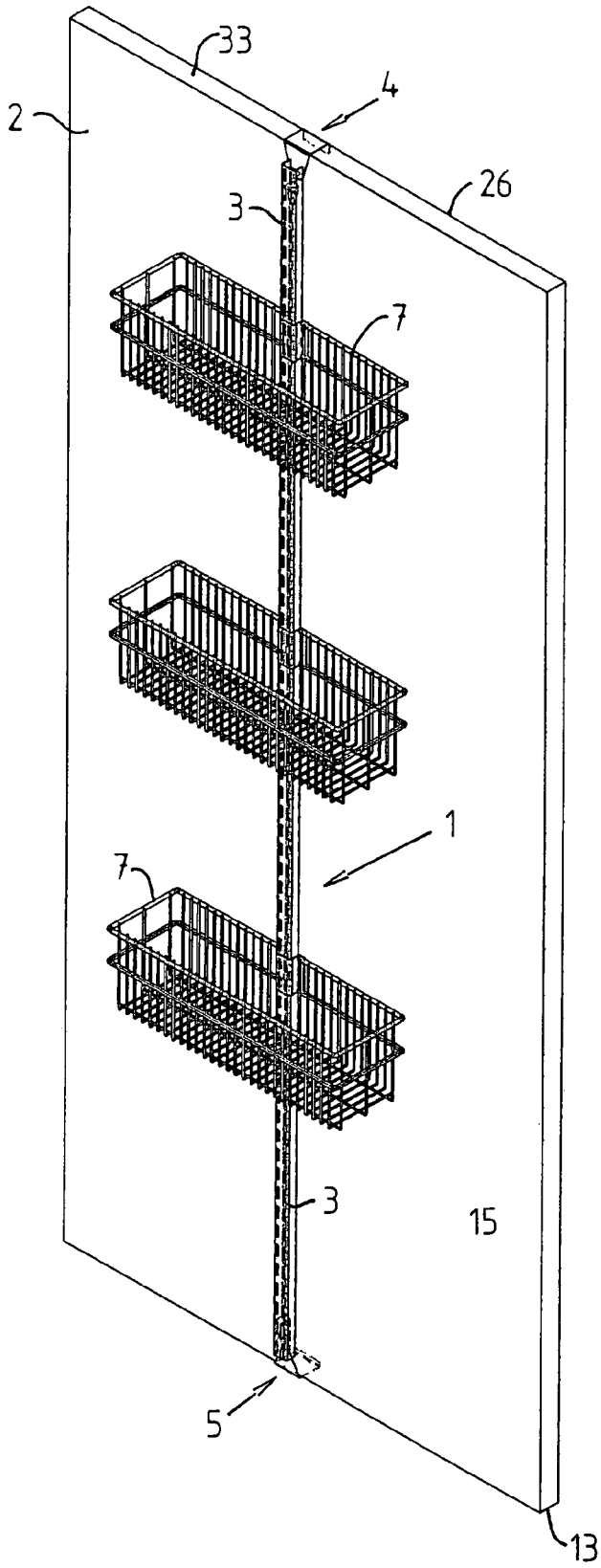
FIG. 1 is a perspective view of a system for storing various objects suspended from a door, in which system a preferred embodiment of the inventive suspension device is included.
Figure 2:
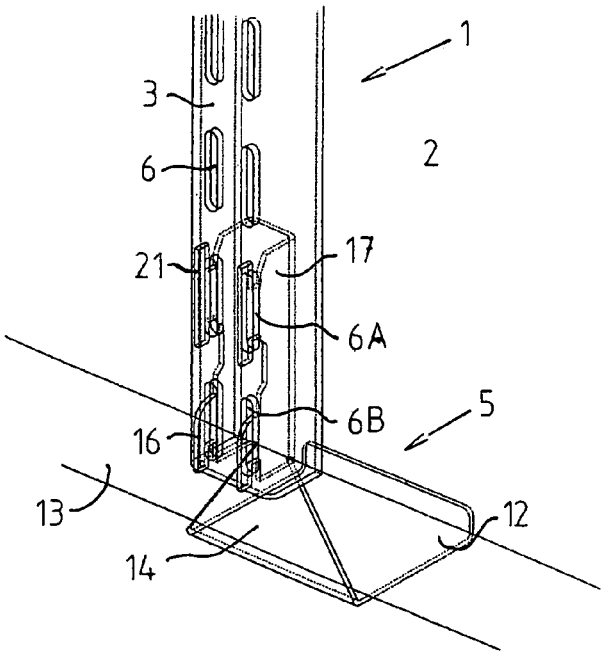
FIG. 2 is an enlarged schematic view of the lower fastener of the suspension device in FIG. 1, the portions of the fastener that are concealed by the rail being indicated by dotted lines.

Reference is first made to FIG. 1, which is a perspective view of a storage system in which an embodiment of the suspension device 1 according to the invention is included. The suspension device 1 is adapted to be detachably mounted on a door, a separate screen wall or the like and is shown in FIG. 1 to be mounted on a door 2. In FIG. 1, the suspension device 1 is shown vertically oriented but may, of course, be oriented horizontally when required, for instance when the storage system is to be mounted on a wide door of small height. When the storage system is to be arranged on a separate screen wall, two or more suspension devices can be used, which may then also act as hang standards as illustrated in the Elfa leaflet "Planerings—och produktguide", i.e. for instance as fasteners for shelf brackets.

The suspension device 1 according to the invention comprises a carrier element or rail 3 and two fasteners, a first fastener 4 which, when mounting the suspension device 1 on a door 2 or the like, is arranged at one end of the carrier element 3, and a second fastener 5 which in said mounting is arranged at the opposite end of the carrier element 3. FIG. 1 shows the first fastener 4 as the upper fastener and, consequently, the second fastener 5 is called the lower fastener. As will be evident from the following description, it is convenient, when mounting the suspension device 1 on a door 2, screen wall or the like, to use the first fastener 4 as the upper fastener, while, when mounting the suspension device on a door located high up, the first fastener should be the lower mounting since the fasteners 4, 5 are of different design. The carrier element 3 can be mounted on and dismounted from the door 2 by means of the fasteners 4, 5.

The carrier element 3 is a long and narrow section with a plurality of through slots or holes 6 for detachable hooking-on of wire baskets 7, shelves, paper roll holders etc. on the carrier element. Preferably the above Elfa hang standard or wall rail is used as carrier element 3; cf. U.S. Pat. No. 5,110,080.

With reference to FIGS. 2–5, the second fastener 5 (in FIG. 1 the lower fastener) comprises a substantially L-shaped element 11 with a first leg 12 which, when mounting the suspension device 1, is engaged with the lower edge side 13 of the door 2, and a second leg 14, which in mounting is adapted to abut against the rear side 15 of the door and which has a hook portion 16. Before mounting the suspension device 1 on the door, the hook portion 16 is inserted into the associated slot/slots or hole/holes 6B in the carrier element 3, whereby the fastener 5 remains suspended from the carrier element and can be placed under the lower edge side 13 of the door by means of the carrier element.

The hook portion 16 can be pivotally attached to the second leg 14, but is preferably fixedly attached to or integrally formed with the second leg 14 of the fastener 5. Moreover the fastener can be made of a bent rod which is round, rectangular or oval in cross-section, but when using the invention on doors, the fastener is preferably made of a metal sheet bent to L shape. Alternatively, the fasteners can be made of a material other than metal, such as reinforced plastic. The hook portion 16 is then suitably made of portions of flanges 17 of the second leg which are bent at right angles to this leg, see in particular FIGS. 2 and 3.

Figure 3:
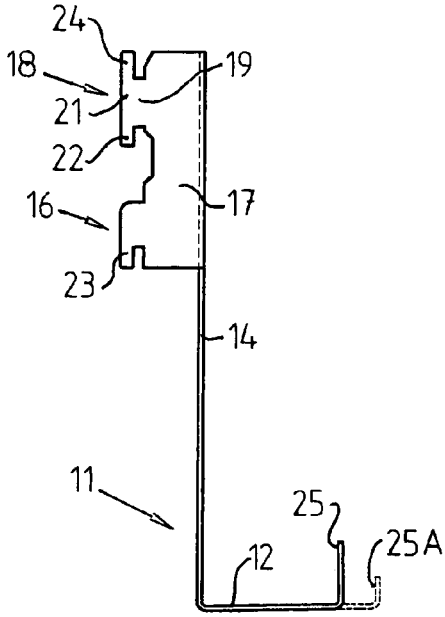
FIG. 3 is a side view of the lower fastener as illustrated in FIGS. 1 and 2.
Figure 4:
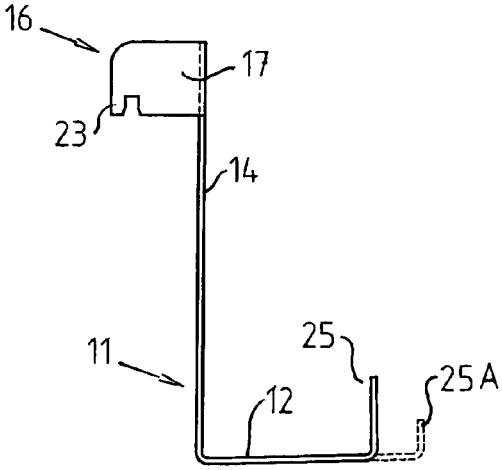
FIG. 4 is a view similar to FIG. 3, showing an alternative design of the lower fastener.

In the design of the lower fastener 5 as shown in FIG. 4, the fastener will swing in the carrier element 3 when this is moved towards the door 2 prior to mounting. In order to counteract this and keep the fastener 5 fixed to the carrier element, a T-shaped portion 18 is formed in the flange/flanges 17 of the second leg 14, see FIG. 3. The distance between the hook portion 16 and the T-shaped portion 18 corresponds to the pitch of the slots 6. The T-shaped portion has a "web" portion 19 and a "flange" portion 21. The "flange" portion 21 has a length which is greater than the length of the slots (holes) 6 and comprises a first projection 22 which, like the projection 23 of the hook portion 16, is directed essentially towards the first leg 12 of the mounting. Further the "flange" portion 21 comprises a second projection 24 which is directed opposite to its first projection 22, and all said projections 22, 23, 24 are aligned with each other.

When arranging the lower fastener 5 on the rail 3, the fastener 5 is moved at an acute angle from inside into the U-shaped rail so that the projection 24 is inserted into the associated slot 6A, and then the fastener is pressed upwards so that the web portion 20 abuts against the upper edge of the slot 6A. In this position, the fastener is pivoted towards the rail, the projection 23 being also inserted into said slot 6A and the hook portion 16 being inserted into the subjacent slot 6B. Once the fastener is released, it slides slightly downwards and is kept fixed to the rail by the projections 24, 23. If desirable, the projection 22 can be eliminated.

Figure 5:
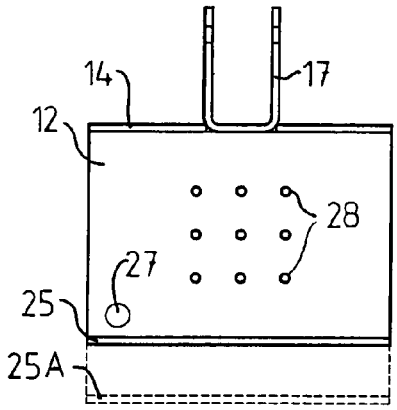
FIG. 5 is a top plan view of the lower fastener according to FIGS. 3 and 4 in alternative embodiments.

With reference to FIGS. 3–5, the first leg 12 of the fastener 5 extends completely over the lower edge side 13 of the door 2. The first leg can be terminated with a third leg 25 which is parallel to the second leg 14 of the fastener and which, when mounting the suspension device 1, abuts against the front side 26 of the door, i.e. the lower fastener 5 encompasses (and hooks around) the lower portion of the door. The lower fastener can be provided for doors of different thicknesses, which is indicated with the third leg 25A displaced in relation to the third leg 25.

To make the lower fastener independent of the thickness of the door 2, the third leg 25, 25A is eliminated, the first leg 12 of the fastener being arranged to extend wholly or partly over the edge side 13 of the door. Then the first leg 12 preferably has one or more through holes 27 so that the fastener can be screwed to the edge side 13. The screw hole in the edge side will certainly be uncovered when the suspension device 1 is removed, but the screw hole hardly affects the appearance of the door 2 since the front and rear sides 26, 15 of the door are intact.

As an alternative to the above discussed fastening of the lower fastener by screwing, a friction-increasing coating can be applied to the side of the first leg 12 which, when mounting the suspension device 1 on the door, will abut against the lower edge side 13. Instead of said coating, point formations 28, i.e. small conical or pyramidal projections, can be formed in the surface of the first leg 12, directed towards the lower edge side 13.

The second or lower fastener 5 has been presented above as a separate unit which is hooked into the carrier element or rail 3. Of course, it is possible to permanently fasten the fastener 5 to the carrier element, for instance by welding or soldering. The fastener can also be made as an integral part of the carrier element, especially if the carrier element is substantially two-dimensional.

The first or upper fastener 4 in FIG. 1 comprises, like the lower fastener, a substantially L-shaped element 31 with a first leg 32 which, when mounting the suspension device 1, is engaged with the upper edge side 33 of the door 2, and a second leg 34, which in mounting is adapted to abut against the rear side 15 of the door. The second leg 34 may exhibit the different embodiments as presented for the first leg 12 of the lower fastener 5, and the portions or components that are common to the various embodiments have been given the same reference numerals, but with the addition in the embodiments according to FIGS. 6–9. Moreover the upper fastener 4 comprises a hook portion 35 which is movably attached to the second leg 34 of the upper fastener 4 (in contrast to the lower fastener in which the hook portion 16 is immovably attached to its second leg 14). When mounting the suspension device 1, the projection/projections 36 of the hook portion 35 is/are oriented in the opposite direction relative to the projection/projections 23 of the hook portion 16 of the lower fastener 5.

The hook portion 35 of the upper fastener 4 is movable in the longitudinal direction of the second leg 34, i.e. when mounting the suspension device 1, it is moved away from the lower fastener 5 (and in dismounting, the hook portion is moved towards the lower fastener). In the illustrated embodiment of the fastener 4, the hook portion 35 is screwably engaged with a bolt 37. The bolt 37 is rotatably supported in a through hole 38 in a supporting element 39 which is fixedly attached to the second leg 34 of the upper fastener, essentially perpendicular thereto. The supporting element 39 can be formed integrally with the fastener that has been bent at (right) angles to the leg 34, especially if the fastener is made of a bent rod which is rectangular or oval in cross-section. When the fastener is made of a metal sheet bent to L shape, the supporting element 39 is preferably a block or the like of metal which is fixedly attached to the second leg 34 of the fastener, for instance by welding or soldering.

Figure 7:
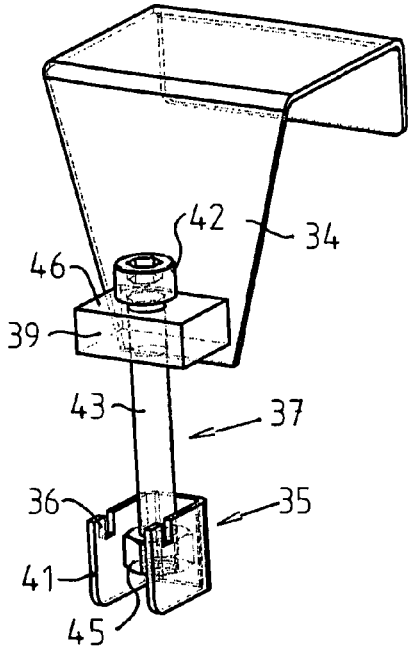
FIG. 7 is a perspective view of the upper fastener as illustrated in FIGS. 1 and 6, removed from the door and the rail.
Figure 8:
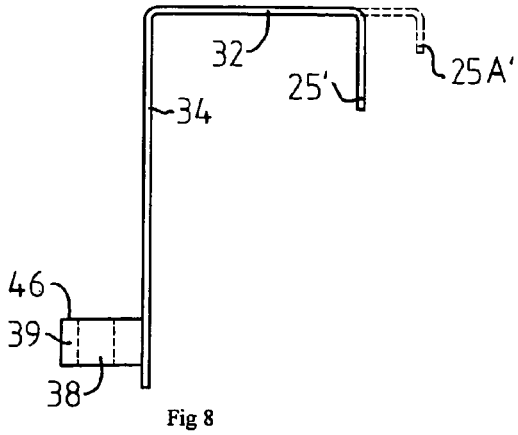
FIG. 8 is a side view of the upper fastener according to FIG. 7.
Figure 10:
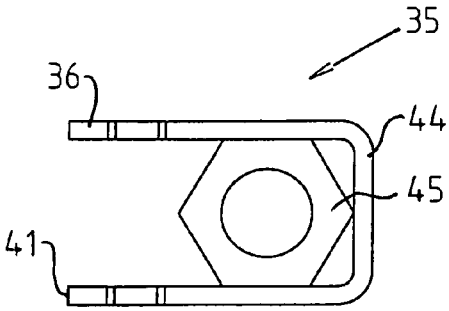
FIG. 10 is a top plan view of the hook portion of the upper fastener, removed from the L-shaped element and the bolt of the fastener.
Figure 9:
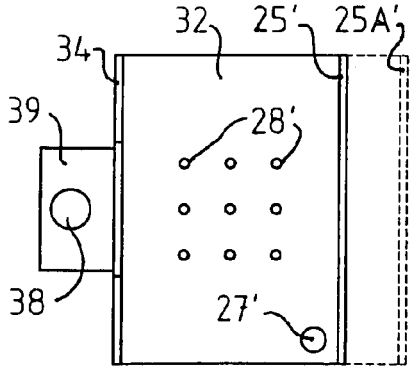
FIG. 9 is a bottom view of the upper fastener according to FIG. 8 in alternative embodiments.

As is evident from FIG. 7, the head 42 of the bolt 37 rests against the upper side or upper face 46 of the supporting element 39, and the threaded shaft 43 of the bolt is screwably engaged with the hook portion 35 on the opposite side of the supporting element. As indicated above, the hook portion comprises a means, which is provided with internal threads and which is fixedly attached to the hook-shaped portion 35 or formed integrally therewith. FIG. 10 shows a currently preferred embodiment of the hook portion 35. In this embodiment, the hook portion comprises a substantially U-shaped element 44, for instance a bent sheet metal component which is enclosingly fixedly attached to a nut 45 by welding, soldering or gluing. The projections 36 are arranged at the free ends 41 of the U-shaped element 44.

To move the hook portion 35 towards or away from the supporting element 39 when mounting the suspension device 1 on and dismounting the same from the door 2, the bolt 37 is rotated by a screw tool being inserted from above into the carrier element 3 to engage with the head 42 of the bolt, after which the bolt is rotated in the intended direction of rotation, cf. FIG. 1. It goes without saying that it is also possible to give access to the bolt through an opening in the carrier element or through an open space between the carrier element and the door (not shown). In this case, a torque transferring device is required between the head 42 and the opening, such as a bent helical spring (not shown), whose one end is fixedly attached to the head 42 and whose other end has a fixedly attached head which can be rotated by a tool so as to rotate the bolt 37.

How the suspension device 1 according to the invention is to be mounted on or dismounted from the door 2 should be obvious from the above, but will now be described in brief.

Figure 6:
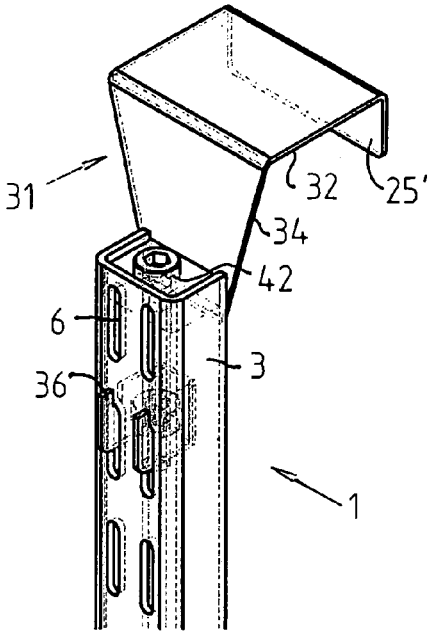
FIG. 6 is an enlarged schematic view of the upper fastener of the suspension device in FIG. 1, the portions of the fastener that are concealed by the rail being indicated by dotted lines.

With reference to FIGS. 1 and 6, the upper fastener 4 is hooked onto the upper edge side 33 of the door or is fastened thereto in the manner described above. Subsequently, the lower fastener 5 is arranged on one end of the carrier element 3, see FIGS. 1 and 2, after which the fastener 5 is hooked onto the lower edge side 13 of the door by means of the carrier element, and the opposite end of the carrier element is moved towards the upper fastener 4. The upper end of the carrier element is pressed against the upper fastener and the upper hook portion 35 is inserted into the associated slots 6 in the carrier element. Finally, the bolt 37 is tightened, thereby moving the hook portion 35 upwards and hooking into the carrier element with its projection 36. In further tightening of the bolt 37, the fasteners 4, 5 are pressed against the upper and lower edge side 33, 13 of the door, and a locking tensile stress is applied to the carrier element. Thus, the suspension device according to the invention is safely and firmly secured to the door.

When dismounting the suspension device, one proceeds in the opposite way, and the appearance of the door has not been affected by the suspension device being used, i.e. the door looks the same after removal of the suspension device according to the invention as before this was mounted on the door.

The invention is not limited to that described above or shown in the drawings, and can be modified within the scope of the appended claims.

The invention claimed is:

1. A device for detachable suspension of baskets, shelves, paper roll holders etc. from a door or the like, comprising;

a carrier element with through slots or holes for holding the baskets, shelves etc., a first fastener and a second fastener, which fasteners carry the carrier element and are adapted to be fixed to the door or the like, wherein each of the first and second fasteners comprises an L-shaped element with a first leg which is adapted to be engaged with one edge side of the door and the opposite edge side, respectively, and a second leg to which the carrier element is fixed in suspension, a first hook portion is movably attached to the second leg of the first fastener, the movable first hook portion is screwably engaged with a bolt, which is rotatably supported in a through hole in a supporting element fixedly attached to the second leg of the first fastener, essentially perpendicular to said second leg, and the first hook portion is arranged to be inserted into the associated slot or hole in the carrier element, whereby, after positioning the fasteners and tightening the bolt, the carrier element will be suspended from the door.

2. A device as claimed in claim 1, wherein the first hook portion is a substantially U-shaped element which is fixedly attached to a nut screwably engaged with said bolt, that the U-shaped element at its free ends has projections directed towards the supporting element, and that the head of the bolt rests on a supporting element surface which is positioned opposite to said nut.

3. A device as claimed in claim 1, wherein a second hook portion is immovably attached to the second leg of the second fastener and is arranged to be inserted into the associated slot or hole in the carrier element.

4. A device as claimed in claim 1, wherein each fastener is made of a metal sheet essentially bent in L shape.

5. A device as claimed in claim 4, wherein the supporting element of the first fastener is a block which is fixedly attached perpendicularly to the second leg of the first fastener and whose through hole is directed towards the second fastener when the carrier element is mounted.

6. A device as claimed in claim 4, wherein the hook portion of the second fastener is integrally formed with the second leg of the second fastener and comprises projections which are arranged essentially at right angles to said second leg and which are directed essentially towards the first leg of the second fastener.

7. A device as claimed in claim 6, wherein the hook portion of the second fastener also comprises a T-shaped portion, which is arranged at a distance from said hook portion which essentially corresponds to the distance between two slots or holes in the longitudinal direction of the carrier element and which has its greatest length in the longitudinal direction of the hook portion which is greater than the length of the slots or holes in the longitudinal direction of the carrier element.

8. A device as claimed in claim 1, wherein the first leg of at least one fastener extends over the edge side of the door and is terminated with a third leg which is essentially parallel to the second leg of the fastener and which in mounting is arranged at the side of the door opposite to the side of the door at which the second leg is positioned.

9. A device as claimed in claim 1, wherein the first leg of at least one fastener extends wholly or partly over the edge side of the door and has at least one through hole for screwing the fastener to the edge side of the door.

10. A device as claimed in claim 1, wherein the first leg of at least one fastener has a point formation adapted to be pressed into the edge side of the door for fixing the fastener to the door.

11. A device as claimed in claim 2, wherein a second hook portion is immovably attached to the second leg of the second fastener and is arranged to be inserted into the associated slot or hole in the carrier element.

12. A device as claimed in claim 2, wherein each fastener is made of a metal sheet essentially bent in L shape.

13. A device as claimed in claim 3, wherein each fastener is made of a metal sheet essentially bent in L shape.

14. A device as claimed in claim 5, wherein the hook portion of the second fastener is integrally formed with the second leg of the second fastener and comprises projections which are arranged essentially at right angles to said second leg and which are directed essentially towards the first leg of the second fastener.

15. A device as claimed in claim 2, wherein the first leg of at least one fastener extends over the edge side of the door and is terminated with a third leg which is essentially parallel to the second leg of the fastener and which in mounting is arranged at the side of the door opposite to the side of the door at which the second leg is positioned.

16. A device as claimed in claim 3, wherein the first leg of at least one fastener extends over the edge side of the door and is terminated with a third leg which is essentially parallel to the second leg of the fastener and which in mounting is arranged at the side of the door opposite to the side of the door at which the second leg is positioned.

17. A device as claimed in claim 2, wherein the first leg of at least one fastener extends wholly or partly over the edge side of the door and has at least one through hole for screwing the fastener to the edge side of the door.

18. A device as claimed in claim 3, wherein the first leg of at least one fastener extends wholly or partly over the edge side of the door and has at least one through hole for screwing the fastener to the edge side of the door.

19. A device as claimed in claim 2, wherein the first leg of at least one fastener has a point formation adapted to be pressed into the edge side of the door for fixing the fastener to the door.

* * * * *